United States Patent [19]

Nakanishi

[11] 4,050,724

[45] Sept. 27, 1977

[54] SASH LOCK

[76] Inventor: Yoshitaka Nakanishi, 12-9, Yawata 5-chome, Ichikawa, Chiba, Japan

[21] Appl. No.: 637,656

[22] Filed: Dec. 4, 1975

[30] Foreign Application Priority Data

Dec. 27, 1974 Japan ..... 49-1248
Dec. 27, 1974 Japan ..... 49-1249

[51] Int. Cl.[2] ..... E05C 3/04
[52] U.S. Cl. ..... 292/241; 70/89
[58] Field of Search ..... 292/241, 242, 210, 108, 292/153, 349, DIG. 7, DIG. 20; 70/89, 90, 95, 287, 307, 312

[56] References Cited

U.S. PATENT DOCUMENTS

| | | | |
|---|---|---|---|
| 963,983 | 7/1910 | Bernhard | 292/241 |
| 2,262,946 | 11/1941 | Kistner | 70/90 |
| 2,634,146 | 4/1953 | Johnson | 70/89 X |
| 2,648,967 | 8/1953 | Holmsten | 70/89 |
| 2,755,654 | 7/1956 | Valentine | 70/89 |
| 3,395,490 | 8/1968 | Diack | 70/90 X |
| 3,903,717 | 9/1975 | Rifkin | 70/89 |

FOREIGN PATENT DOCUMENTS

| | | | |
|---|---|---|---|
| 651,872 | 4/1951 | United Kingdom | 292/58 |

*Primary Examiner*—James T. McCall
*Attorney, Agent, or Firm*—Robert E. Burns; Emmanuel J. Lobato; Bruce L. Adams

[57] ABSTRACT

Sash lock comprising a rotatable latch cam engageable with a keeper, a locking member for unlockably locking the latch cam to control the rotation of the latch cam, and a rotatable knob for shifting the lock member to a locked position or an unlocked position.

11 Claims, 7 Drawing Figures

SASH LOCK

BACKGROUND OF THE INVENTION

This invention relates to a sash lock, particularly to a sash lock having a means which is able to lock a latch cam when the latch cam is engaged with a keeper.

An object of this invention is to provide a sash lock which may positively lock the latch cam and may not easily be opened from outside.

Another object of this invention is to provide a sash lock which may easily be locked or unlocked from inside.

Still another object of this invention is to provide a sash lock which is simple, compact and strong, while its external appearance is fine and its locking and unlocking is easy.

SUMMARY OF THE INVENTION

According to this invention, there is provided a sash lock which comprises a rotatable latch cam pivoted to a base and engageable with a keeper, a locking member for locking and unlocking the latch cam, and a rotatable knob for shifting the locking member to be locked position or an unlocked position.

BRIEF DESCRIPTION OF THE DRAWINGS

These and other objects as well as characteristics of this invention will be apparent to persons skilled in the art from the study of the following description with reference to the accompanying drawings, in which.

DESCRIPTION OF A PREFERRED EMBODIMENT

Figure 1:
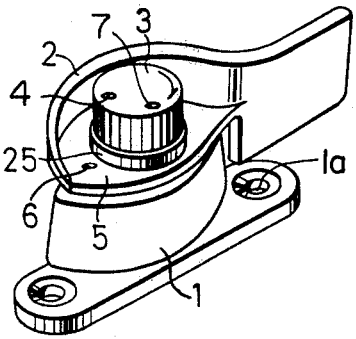
FIG. 1 is a perspective view of a sash lock according to this invention, showing it in a state of where it has a locked latch cam.

Referring to FIG. 1, there is shown a sash lock comprising a base member (1), having holes 1*a* for screws for securing it to a sash member (not shown). A latch cam (2) is pivoted to the base member for latching it to a secured sash member (not shown). The latch cam can be engaged with a keeper (not visible in this figure). There is also shown a rotatable operating knob (3) with an inner, circumferential or peripheral serration for locking or unlocking the latch cam. When a mark (4) stamped on the top portion of the knob is opposite to a mark (6) stamped on a plate portion (5) of the latch cam, as shown in FIG. 1, it is shown that the latch cam is locked. When the knob (3) is turned counterclockwise from the state of FIG. 1 until another mark (7) on the knob is opposite to the mark (6) of the latch cam, it is shown that the latch cam is unlocked the two marks, and corresponding inner serrations, being circumferentially spaced apart, for example by 90° as shown. In this unlocked state, the latch cam (2) may be turned nearly 180° to disengage the same with the keeper.

Figure 2:
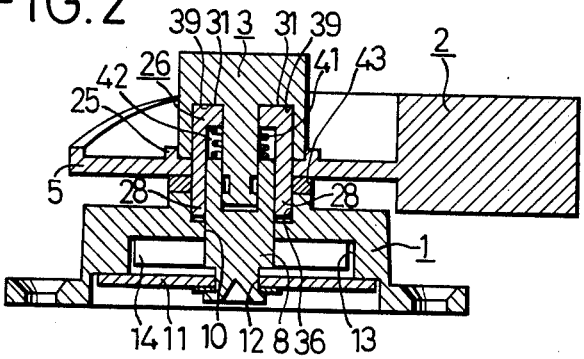
FIG. 2 is a vertical longitudinal section of the lock of FIG. 1, showing it in the same state.
Figure 5:
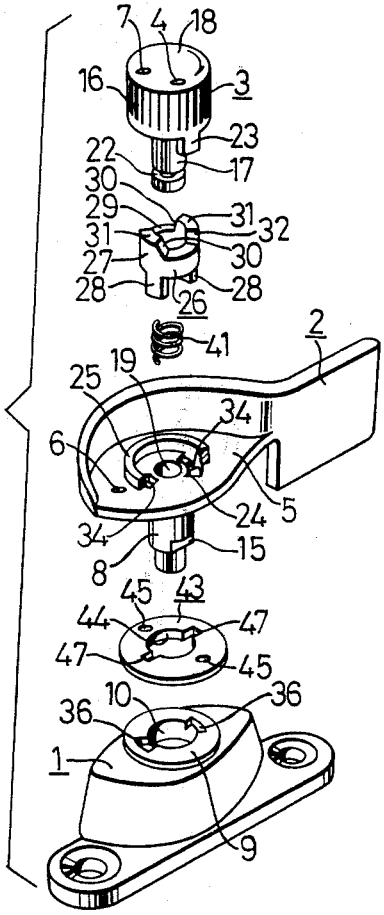
FIG. 5 is an exploded perspective view of the lock of FIG. 1.
Figure 6:
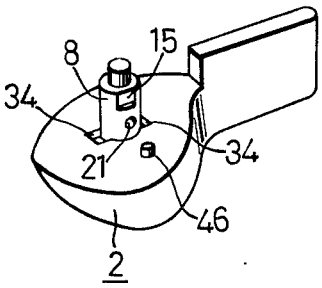
FIG. 6 is a perspective view of the latch cam, shown upside down.

Referring to FIG. 2, FIG. 5 and FIG. 6, the latch cam (2) has a shaft (8) integrally formed on and normal to the back of the plate portion (5) of latch cam and the shaft is passed through a central opening (10) in a top wall (9) of the base portion (1), and through a central opening (12) in a washer (11) which closes the back of the base member. By caulking the tip of the shaft (FIGS. 2 and 3), it is pivotally attached to the base member.

Figure 3:
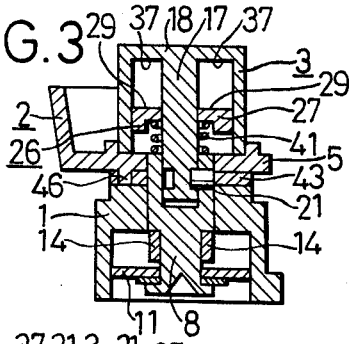
FIG. 3 is a vertical cross section of the lock of FIG. 1, showing it in the same state.

Between the base member (1) and the washer (11), there is a space in which two leaf springs (14) are secured to the under side of the base member (FIG. 2) so as to pinch the rotatable shaft (8) elastically (FIG. 3). A flat side face (15) is formed on the rotatable shaft (8), and when the latch cam (2) is located either at engaged position with the keeper provided by these members 14, 15 or therefrom, the leaf spring (14) engages with the flat side face (15) of the rotatable shaft to keep the latch cam in the respective positions.

Figure 7:
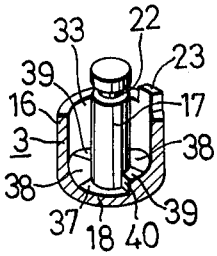
FIG. 7 is a perspective view seen from the back of the of the lock, shown upside down.

The knob (3) is formed like a cup, an outside surface of its cylindrical peripheral wall (16) is serrated or knurled (FIG. 1) for preventing slippage. Within the wall 16 a rotatable shaft (17) is coaxially secured to a top wall (18) of the knob (FIG. 7). A free end of the shaft (17) extends outwards beyond the free end of the wall (16), and has an annular groove (22). The shaft (17) is rotatably inserted into a central opening (19) coaxially recessed into an upper end of the rotatable shaft (8) to one end of a stop pin (21) which is inserted into a cross bore of the shaft (8) engages with the annular groove (22) of the knob, which is thereby rotatably connected with the latch cam (2) (see FIG. 3).

As best shown in FIG. 5 and to limit the rotating angle of the knob (3), there is formed a projection (23) on the end face of peripheral wall (16) of the knob (3). The projection (23) is inserted into a segmental groove (24), which is formed concentrically with the central opening (19) on the surface of the plate portion (5) of the latch cam, thereby limiting rotation of the knob (3) relative to cam 2, to an arc defined by groove (24). In case of the knob shown in the drawings, its angle of rotation partly shown in FIG. 5 and more fully in FIGS. 2 and 3 is 90°. An annular wall (25) is integrally formed on the surface of the plate portion (5) so as to encircle the segmental groove (24) and to encircle the outer face of the lower end of the wall (16) of the knob (3) in order to conceal the gap between the end face of peripheral wall (16) of the knob and the plate portion (5) of the latch cam, for the sake of better appearance.

A locking member (26) for the latch cam (2) is disposed coaxially with the latch cam (2) and knob (3) will directly lock or unlock the latch cam according to the rotation of the knob (3) in clockwise or counter-clockwise direction. By connecting the latch cam (2) with the base member as one body, or by disconnecting them, the rotation of the latch cam relative to the base member is effected or prevented respectively.

This locking member (26) for the latch cam as shown in FIG. 5, has therewith, a cylindrical body portion (27), on the lower end of which two legs (28, 28) are formed dimetrically opposite one another and on the upper end of which two protruding cam surfaces are formed diametrically opposite one another. Each protruding cam surface has a lower (recessed) flat cam surface (29), an inclined cam surface (30) which is connected with the surface (29), a higher (projecting) flat cam surface (31) which is connected with the surface (30), and a vertical cam surface (32) which is connected with the surface (31), thus the cam surfaces similar to the teeth of a saw. The cam surfaces of the locking member (26) are confronting with the back of the top wall (18) of the knob (3) and on the back of this top wall, there are integrally formed two protruding cam surfaces, each of which has a surface which engages with the locking member's cam surface (see FIG. 7). The configuration of the cam surface of the knob (3) is formed symmetrically and, as shown, conformably with respect to the cam surface of the locking member (26), having a lower flat cam surface (37) on the flat back of top wall (18) of the knob, an inclined cam surface (38) which is connected with the flat cam surface and engageable with the inclined cam surface (30) of the locking member, a higher flat cam surface (39) which is connected with the inclined cam and engageable with the higher flat cam surface (31) and the lower flat cam surface (29) of the locking member, and a vertical cam surface (40) which is connected with the flat cam surface (39) and engageable with the vertical cam surface of the locking member.

The locking member (26) is inserted in an annular space (33) between the peripheral wall (16) of the knob and the rotatable shaft (17), and the height of the knob may be lowered to the extent of insertion of the locking member. The legs (28) of the locking member may be engaged with two guide openings (34) and with two receiving recessed at holes (36) provided respectively in cam 2 and on the top surface of a raised portion (35) of the base member (see FIG. 5).

The two guide openings (34) of the latch cam are arranged at substantially symmetrical positions on a circle concentric with the central opening of the base member to one of the guide openings (34) is formed on bottom wall of the segmental groove (24) and the size of the guide opening (34) is smaller than that of the groove (24) and is so dimensioned as to receive and surround the leg (28). The receiving holes (36) of the base member are formed in the same shape as the guide openings (34) of the latch cam and a portion of the former communicates with the central opening (10).

When the guide openings (34) of the latch cam are aligned with (tally with) recesses (36) of the base member, the latch cam is either in a position where it can sufficiently engage with the keeper 14, 15, or in a position where it can sufficiently disengage from the keeper, in such portions the legs (28) of the locking member can engage with both of the guide openings (34) of the latch cam and the recess (36) of the base member to prevent the rotation of the latch cam to. By contrast, when the legs 28 merely engage with the guide openings (34) of the latch cam and do not engage with the recesses (36), the latch cam can be rotated.

The locking member (26) is urged by a coil spring (41) in the direction against the top wall of the knob so as to maintain mutual engagement between the locking member and the cam surface of the knob at all times. The coil spring (41) is inserted in an annular space between the legs (28) and the rotatable shaft (17) of the knob, and surrounds the rotatable shaft (17) as well as being surrounded by the legs (28), and one end of the spring abuts against an end face of the cylindrical body portion 27 while another end thereof abuts against the plate portion (5) of the latch cam.

When the latch cam (2) is in a position where it sufficiently engages with the keeper (14,15) and the knob is in a position where the mark (4) of the knob (3) is opposite to the mark (6) of the latch cam, the higher flat cam surface (39) of the knob engages with the higher flat cam surface (31) of the locking member (26), and the locking member (27) is then in a lower and locking position, where the legs (28) of the locking member engage both of the guide openings (34) of the latch cam and the receiving holes (36), thus the latch cam is locked (FIG. 2).

Figure 4:
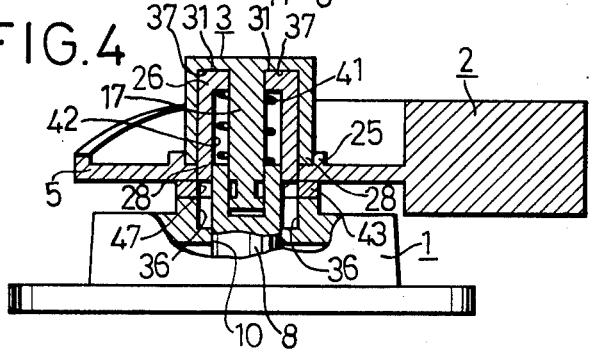
FIG. 4 is a partially sectioned vertical longitudinal view similar to FIG. 2, showing it in a state where the latch cam is unlocked.

In this locked state, when the knob (3) is counterclockwise rotated until its mark (7) is opposite to the mark (6) of the latch cam, the higher flat cam surface (39) of the knob will be disengaged from the higher flat cam surface (31) to engage with the lower flat cam surface (29) of the locking member while the higher flat cam surface (31) of the locking member will engage the lower flat cam surface (37) of the knob, thus the locking member is raised by the coiled spring (41) to the extent of the height of both of higher flat cam surfaces (31) and (39), to disengage its legs (28) from the recesses (36) of the base member, and the latch cam will be unlocked for free rotation (FIG. 4).

In this unlocked state, when the knob (3) is clockwise rotated, the inclined cam surface (38) of the knob presses down the inclined cam surface (30) of the locking member (26) to engage again the higher flat cam surface (39) of the knob with the higher flat cam surface (31) of the locking member, thus the locking member will be lowered to the original locked position.

When the projection (23) of the knob (3) is in a position where it abuts against one end of the groove (24), the latch cam is in a locked state, while it abuts against another end thereof, the latch cam is under unlocked state.

In case the latch cam (2) and the base member (1) are formed of metallic material, the rotation of the latch is apt to become heavy. But, when a washer (43) formed of synthetic resin having self lubricating property is provided on the contact surface of the latch cam (2) and the base member (1), the latch cam will be rotated smoothly. The washer (43) may be rotated together with the latch cam as one body, when a central opening (44) of the washer is fitted on the rotatable shaft (8) of the latch cam (2) and when an aperture (45) of the washer is engaged by a projection (46) which is provided on the back of the plate portion (5) of the latch cam. The washer, also has slots (47) which will allow the legs (28) of the locking member to pass through them.

It is to be understood that the present invention is not limited to the above mentioned embodiment thereof, but may be otherwise variously modified within the scope of the following claims.

What is claimed is:

1. A sash lock, comprising:

a base member;

a latch cam having a latch cam shaft for rotatably mounting the latch cam on the base member;

a locking member for unlockably locking the latch cam against rotation thereof on the base member, the locking member having a cylindrical body portion which coaxially surrounds the cam shaft and is shiftable along the same in one direction for locking and in an opposite direction for unlocking the latch cam, the locking member also having a leg, which projects from one end of the cylindrical body portion, and having means defining a locking cam surface which projects from another end of the cylindrical body portion, the latch cam having a guide opening to guide the leg of the locking member in the locking and unlocking of the latch cam, and the base member having a recess which can be aligned with the guide opening by rotation of the latch cam on the base member to permit, when the guide opening is aligned with the recess, reversible insertion of the leg in the guide opening and recess to lock the latch cam to the base member;

a knob having a knob shaft which coaxially, rotatably pivots the knob to the cam shaft and to the cylindrical body portion of the locking member, the knob also having a portion which defines a knob cam surface conformably matching the locking cam surface for the locking and unlocking of the latch cam, the knob cam surface and the locking cam surface each having a recessed flat cam portion, a projecting flat cam portion, and an inclined cam portion interconnecting the flat cam portions, and the flat cam portions being normal to the shaft; and a spring on the base member and latch cam, urging the locking member against the knob cam surface;

whereby, when the recessed flat portion of the knob cam surface and the projecting flat portion of the locking cam surface are mutually engaged, the spring shifts the locking member in the direction for unlocking; and when the projecting flat portions of both surfaces are mutually engaged the spring is counteracted thereby, the locking member is shifted in the direction for locking, and the leg is inserted in the recess, locking the latch cam to the base member.

2. A sash lock according to claim 1, wherein the knob has a cylindrical outer wall and a top wall closing one end of the outer wall, the knob shaft being secured to an inside portion of the top wall, and being radially spaced from the outer wall of the knob to provide a space in which the locking member is inserted.

3. A sash lock according to claim 1, wherein the locking member has a second leg disposed diametrically opposite the first-mentioned leg on a circle concentric with the latch cam shaft, the cam having a second guide opening and the base member having a second recess, the second guide opening and the second recess being engageable with the second leg by the rotation of the latch cam.

4. A sash lock according to claim 1, wherein the cam surface of the knob and the cam surface of the locking member engageable therewith is respectively provided with second recessed, projecting and inclined cam portions so as to diametrically confront one another on circles, on the knob and on the locking member, said circles being coincident with circles defined by the first-mentioned cam portions.

5. A sash locking according to claim 1, wherein the knob has a projection on one end of its outer wall, the latch cam having a segmental guide groove which engages said projection to limit the rotation of the latch cam, and wherein, when said projection engages a first end of the guide groove, the locking member is in a locking position and when said projection engages an opposite end of the guide groove, the locking member is in an unlocking position with respect to the latch cam.

6. A sash lock according to claim 1, additionally including a wash of self-lubricating, synthetic resin, coaxially disposed between the latch cam and the base member.

7. A sash lock according to claim 6, wherein said washer has a central opening which fits the latch cam shaft, and has an aperture spaced from the central opening, the latch cam having a projection on a plate portion thereof, spaced from the latch cam shaft, engageable with the aperture of the washer, and disposed so that, when it engages the aperture of the washer, the washer is rotatable together with the latch cam as one body.

8. A sash locking according to claim 1, wherein the knob has two marks, and the latch cam has a mark which can be aligned with the marks of the knob so that, when the knob is rotated to align one of its marks with the mark of the latch cam, the latch cam is locked, and that, when another mark of the knob is aligned with the mark of the latch cam, the latch cam is unlocked.

9. A sash lock according to claim 1 additionally including keeper means for resiliently keeping the latch cam in locked and unlocked positions thereof when it, under control of the knob, has been disposed in such positions.

10. A sash lock according to claim 9 in which the keeper means includes spring means secured to the base member; the latch cam shaft having a portion engageable with the spring means by positioning the latch cam in either of said positions.

11. A sash lock according to claim 10, in which the spring means comprises a flat spring secured to the latch cam oposite the knob, and the shaft portion engageable therewith comprises a flat portion of the latch cam shaft.

* * * * *

UNITED STATES PATENT AND TRADEMARK OFFICE

CERTIFICATE OF CORRECTION

PATENT NO. : 4,050,724
DATED : December 4, 1975

INVENTOR(S) : Yoshitaka Nakanishi

It is certified that error appears in the above-identified patent and that said Letters Patent are hereby corrected as shown below:

Part [30] of the patent should show:

the "Foreign Application Priority, Data"

as follows:

December 27, 1974, Japan...50-1248

December 27, 1974, Japan...50-1249

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*